United States Patent [19]

Saito

[11] Patent Number: 5,025,893

[45] Date of Patent: Jun. 25, 1991

[54] VIBRATION SUPPRESSING DEVICE FOR ELEVATOR

[75] Inventor: Saburo Saito, Yokohama, Japan

[73] Assignee: Otis Elevator Company, Farmington, Conn.

[21] Appl. No.: 362,172

[22] Filed: Jun. 6, 1989

[30] Foreign Application Priority Data

Jun. 10, 1988 [JP] Japan ..... 63-143353

[51] Int. Cl.[5] ..... B66B 11/04

[52] U.S. Cl. ..... 187/20; 254/395

[58] Field of Search ..... 187/20, 22, 1 R; 254/394, 395

[56] References Cited

U.S. PATENT DOCUMENTS 1,352,632 9/1920 Ross ..... 187/20

1,419,783 6/1922 Julien ..... 187/20

3,666,051 5/1972 Davis et al. ..... 187/20

4,465,161 8/1984 Ohta et al. ..... 187/20

FOREIGN PATENT DOCUMENTS 41336 3/1977 Japan ..... 187/20

*Primary Examiner*—Robert P. Olszewski

*Assistant Examiner*—Kenneth Noland

*Attorney, Agent, or Firm*—William W. Jones

[57] ABSTRACT

An elevator rope guide assembly prevents or lessens vibrations of the ropes connected to the cab by means of auxiliary guide rollers pairs disposed on either side of the cab sheave. Additionally, the cab sheave has rope-engaging grooves which are substantially deeper than the diameter of the rope and include outwardly divergent sides.

5 Claims, 2 Drawing Sheets

VIBRATION SUPPRESSING DEVICE FOR ELEVATOR

FIELD OF THE INVENTION

The present invention relates to a long-distance elevator of the type in which a cab and a counterweight are suspended from a driving sheave around which a plurality of ropes are doubly wound at a ratio such as 2:1 and 3:1. In particular, the invention is concerned with a device for suppressing the vibration of the ropes during operation of the elevator.

BACKGROUND ART

Elevators which are double wound with sheaves on the cab to obtain a 2:1 ratio or larger, will experience rope oscillations when installed for runs which are of long duration In some cases, the travel of an elevator is as large as 500 to 600 meters as in the cases of tall buildings and dams. In general, lateral oscillation or interference of ropes do not occur when the travel distance is about 150 meters or so. Unfortunately, however, lateral oscillation of the rope inevitably takes place when the travel distance exceeds 150 meters or so. In addition, troubles such as mutual interference of the ropes tends to occur particularly in the case where the ropes are wetted as often experienced in mines. The mutual interference of the ropes may be considerable particularly when the resonance frequency of the rope coincides with the frequency of lateral vibration of the rope, and even rotational oscillation of the cab may occur in the worst case.

BRIEF SUMMARY OF THE INVENTION

According to the present invention, there is provided a vibration suppressing device for an elevator comprising: a grooved sheave rotatably mounted on the top wall of the elevator cab; and a pair of guide rolls arranged in abutting condition and fixed at a position above the grooved sheave, the grooved sheave having grooves each having a cross-section with an arcuate bottom portion for receiving a portion or the rope, the cross-section linearly diverging from both ends of the arc, the guide rolls having grooves each having a semi-circular cross-section.

In a specific form of the invention, the arcuate cross-section of the bottom of each groove in the grooved sheave has a radius slightly greater than the radius of the rope which is to be received in this groove, while the distance between the bottom of the groove and the surface of the sheave is about 1.5 times as large as the diameter of the rope, the radius of the semi-circular cross-section of the groove in the guide roll being slightly greater than the radius of the rope to be received in the groove.

In order to prevent lateral oscillation of the ropes, it is necessary that the ropes are firmly gripped. This could be realized by adopting sheaves having deep grooves. The deep groove can be formed such that the groove has a semi-circular bottom and both ends of the semi-circular form extend vertically to form parallel walls so as to receive a rope. In such a case, however, the rope tends to come off the groove by jumping over the parallel wall. On the other hand, a V-shaped groove suffers a problem in that the rope which is deformed by load is pressed onto the groove bottom so as to cause a wear and deformation of the groove with the result that the rope cannot smoothly clear the groove, although it can prevent the rope from jumping off the groove.

According to the present invention, the groove in the grooved sheave has an arcuate bottom which receives a portion of the rope and the cross-section of the groove is so determined as to have walls which linearly diverge from both ends of the arc of the groove bottom. With this arrangement, it is possible to securely grip the rope so as to suppress lateral oscillation, while eliminating deformation of the groove due to wear and preventing the rope from jumping off the groove.

Accordingly, it is in an object of the present invention is to provide a rope vibration suppressing device which is designed to effectively suppress lateral oscillation and mutual interference of ropes during running of the elevator cab.

It is a further object of this invention to provide a rope vibration suppression assembly of the character described having a deeply grooved cab sheave wherein the rope grooves have outwardly diverging sides.

It is an additional object of the invention to provide a rope vibration suppression assembly of the character described having grooved guide pulley pairs on the cab on either side of the cab sheave for guiding movement of the rope onto and off of the cab sheave.

These and other objects and advantages of the invention will become more readily apparent from the following detailed description of a preferred embodiment of the invention when taken in conjunction with the accompanying drawings, in which:

BEST MODE FOR CARRYING OUT THE INVENTION

Figure 1:
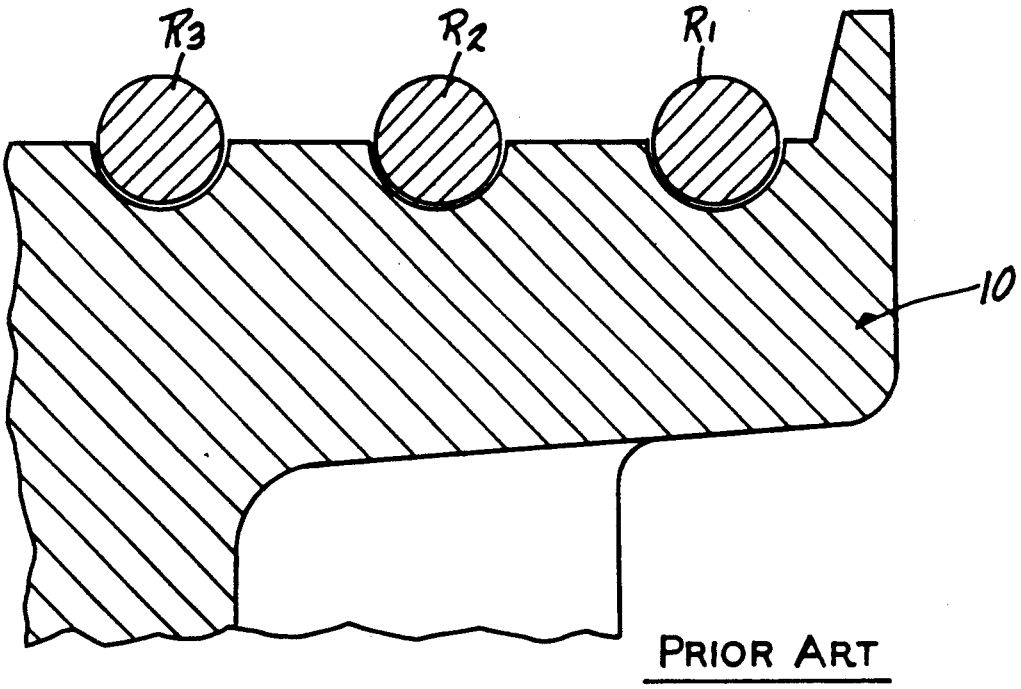
FIG. 1 is a fragmentary sectional view of a portion of a grooved cab sheave used in the prior art.
Figure 2:
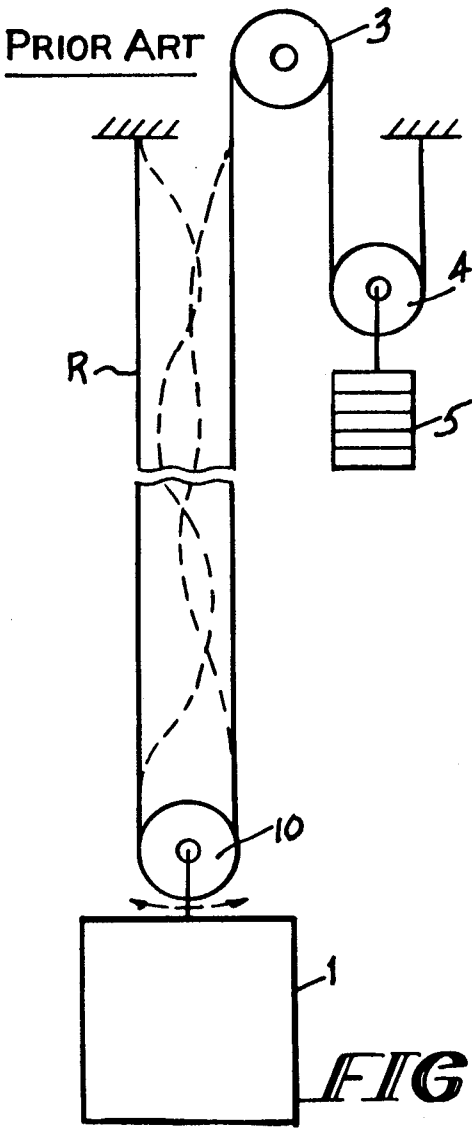
FIG. 2 is a side elevational view of a prior art elevator system using the sheave of FIG. 1.

A conventional rope vibration suppressing device will be described with specific reference to FIGS. 1 and 2. Referring to FIG. 2, an elevator has a cab 1, a sheave 10 rotatably mounted on the top wall of the cab 1, a hoisting traction sheave 3, a balance sheave 4, a balance weight 5 and ropes R. Referring to FIG. 1 which is a sectional view of the sheave 10, the sheave 10 has grooves each having a substantially semi-circular cross-section which is slightly greater than the circular cross-section of each rope $R_1$, $R_2$ and $R_3$. In operation, the rope is pressed onto the sheave so that the rope is slightly deformed into an oval form in cross-section. This tends to cause wear and deformation of the groove which receives the deformed rope. In this embodiment, however, this problem is overcome because the substantially semi-circular cross-section of the groove is determined to be slightly greater than the corresponding portion of the cross-section of the rope.

As will be seen from FIG. 2, the rope R is fixed at its one end to the top of the hoistway and is suspended therefrom. The rope R then goes around the sheave 10, the traction sheave 3 and the counterweight sheave 5. The rope then leads upward so as to be connected to the top of the hoistway.

Figure 3:
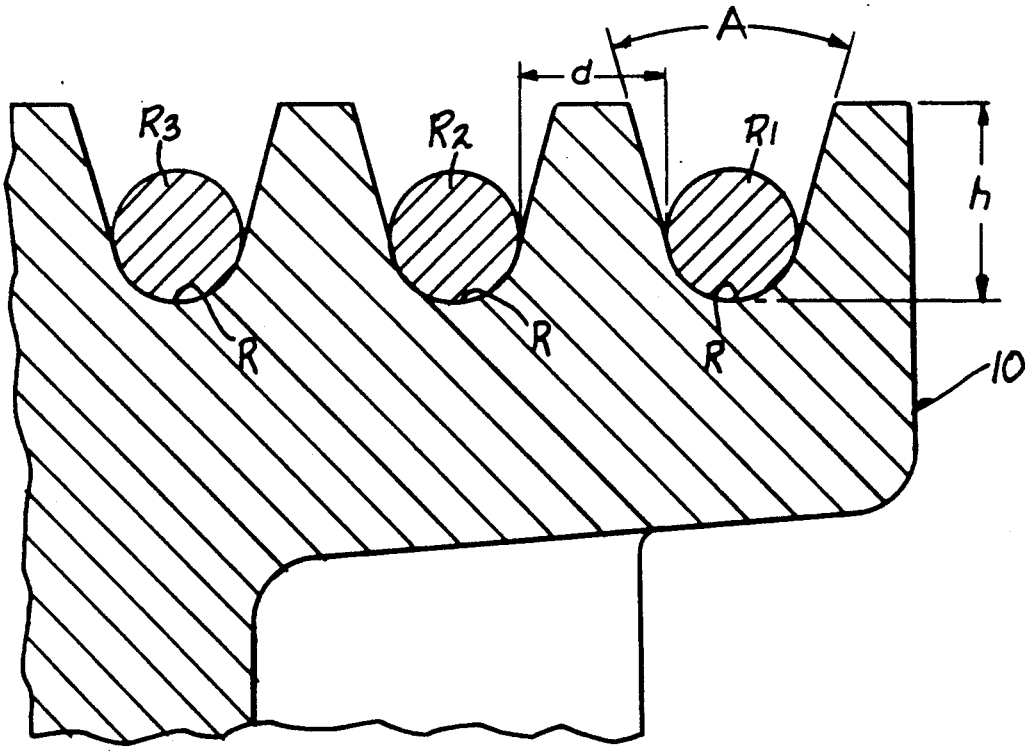
FIG. 3 is a view similar to FIG. 1 but showing the cab sheave formed in accordance with this invention.
Figure 5:
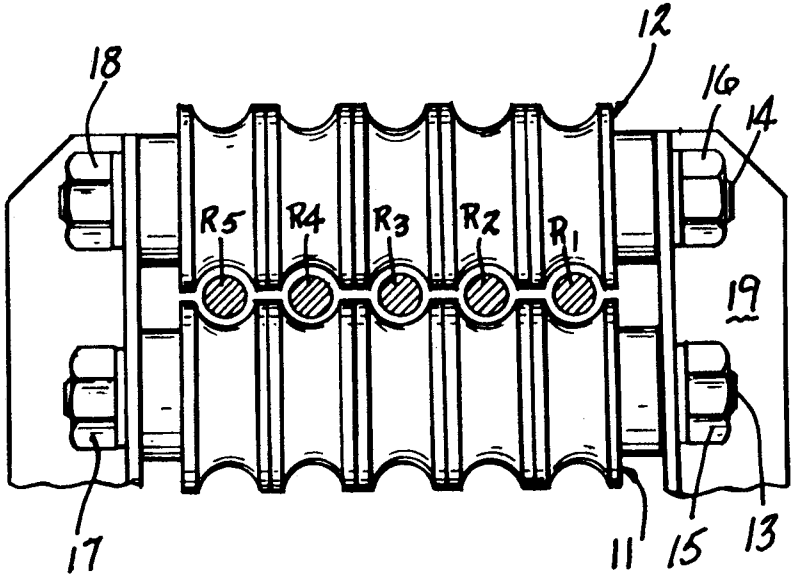
FIG. 5 is a fragmented elevational view of one of the guide pulley pairs used to feed rope onto and off of the cab sheave.
Figure 4:
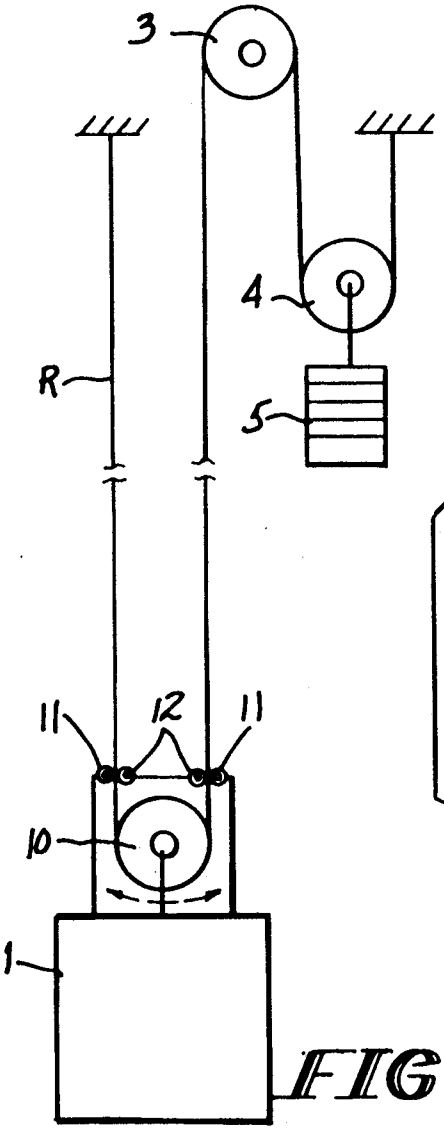
FIG. 4 is a view similar to FIG. 2 but showing the rope vibration suppressing assembly of this invention.

An embodiment of the present invention will be described with reference to FIGS. 3–5. A grooved sheave 10 rotatably fixed to the top of the cab has grooves each having a cross-section defined by an arcuate bottom which receives a part of each rope and by walls which linearly diverge from both ends of the arc of the bottom as shown in FIG. 3. In one embodiment of the present invention, the arcuate bottom portion has a radius R which is not smaller than the rope radius (rope having a diameter of 13 mm) but does not exceed rope radius plus 0.35 mm, taking into account possible deformation of the rope under the load. The distance h between the groove bottom and the sheave surface is determined to be 1.5 times as large as the rope diameter, while a distance d between parallel tangent lines to adjacent ropes (14 mm in this case) is greater than the rope diameter and is preserved between adjacent ropes. The angle A of divergence of the groove is preferably within the range of 30°±5°. A vibration suppressing guide as shown in FIG. 4 is situated at a position which is about 1 to 1.5 meters above the top wall of the cab. The guide has guide rollers 11 and 12 with grooves each having a semi-circular cross-section slightly greater than the semi-circle of the rope cross-section as seen in FIG. 5. The sheaves and the rolls are preferably made from polymeric nylon.

According to the present invention, it is possible to effectively suppress the vibration of ropes during running of a cage in a long-distance elevator system.

The depth of the grooves on the cab sheave and the fact that they are provided with a base radius which is substantially equal to the radius of the hoist ropes ensures that the cab sheave will firmly grip the ropes. The linear outwardly diverging sides of each sheave groove ensures that the ropes will not climb out of the grooves, and the guide rollers provide smooth feeding of the ropes into and out of the sheave grooves.

Since many changes and variations of the disclosed embodiment of the invention may be made without departing from the invention concept, it is not intended to limit the invention otherwise than as required by the appended claims.

What is claimed is:

1. An elevator hoist rope vibration suppressing assembly comprising:

(a) an elevator cab;

(b) a grooved sheave rotatably mounted on top of said elevator cab, said grooved sheave receiving the elevator hoist ropes; and (c) two pairs of grooved guide rolls mounted on top of said elevator cab with each pair of guide rolls engaging the hoist ropes at points upwardly offset from and on both sides of the grooved sheave to restrain lateral movement of the hoist ropes as the latter are fed onto and off of the grooved sheave, whereby lateral vibratory movement of the hoist ropes above the cab is suppressed.

2. The assembly of claim 1 wherein the grooves in said sheave have a bottom radius which is slightly larger than the radius of the hoist ropes, and have radially outwardly divergent side walls operable to ensure retention of the hoist ropes in the sheave grooves.

3. The assembly of claim 2 wherein said guide rolls are formed with semi-circular hoist rope-engaging grooves.

4. The assembly of claim 2 wherein the distance between the bottom of each sheave groove and the outer surface of the sheave is about 1.5 times the diameter of the hoist ropes.

5. The assembly of claim 2 wherein said sheave groove side walls have an included angle of divergence in the range of about 25° to about 35°.

* * * * *